US006840057B2

(12) United States Patent
Yun et al.

(10) Patent No.: US 6,840,057 B2
(45) Date of Patent: Jan. 11, 2005

(54) REFRIGERATOR FOR OPTIMIZING INSIDE TEMPERATURE OF COOLING CHAMBER

(75) Inventors: Young Hoon Yun, Daegu-si (KR); Moo Youl Kim, Seoul (KR); Sang Ho Seo, Gwangmyeong-si (KR); Dong Hoon Lee, Incheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/431,007

(22) Filed: May 8, 2003

(65) Prior Publication Data

US 2004/0144125 A1 Jul. 29, 2004

(30) Foreign Application Priority Data

Jan. 27, 2003 (KR) ..... 10-2003-0005331

(51) Int. Cl.[7] ..... F25D 17/04
(52) U.S. Cl. ..... 62/407; 62/441
(58) Field of Search ..... 62/407, 441, 408, 62/411, 412

(56) References Cited

U.S. PATENT DOCUMENTS 5,009,080 A * 4/1991 Naganuma et al. ..... 62/256
6,405,547 B2 * 6/2002 Hiraoka et al. ..... 62/180

* cited by examiner

*Primary Examiner*—Melvin Jones
(74) *Attorney, Agent, or Firm*—Fleshner & Kim, LLP

(57) ABSTRACT

An improved structure for uniformly distributing cold air throughout a refrigerator is provided. Cold air is discharged vertically downward through a cooling air supply device positioned in an upper portion of the refrigerator to reduce temperature variation between an upper part of the refrigerator and a lower part of the refrigerator so that temperature in the refrigerator may be maintained at a uniform level. Positioning the cooling air supply device and distributing the colling air in this manner obviates the need for additional equipment positioned throughout the refrigerator to augment cooling capability, thus allowing for optimized use of space in the refrigerator.

30 Claims, 4 Drawing Sheets

REFRIGERATOR FOR OPTIMIZING INSIDE TEMPERATURE OF COOLING CHAMBER

BACKGROUND OF THE INVENTION

1. Field of the Invention

The present invention relates to a refrigerator and more particularly to a structure for discharging cold air in a refrigerator, capable of reducing temperature difference between an upper part and a lower part, and a shelf and a basket.

2. Background of the Related Art

A refrigerator, which is an apparatus for storing food in low temperature, is classified into a refrigerator that is tens of liters—hundreds of liters in its volume, for home use, and a refrigerator that is tens of kiloliters in its volume, for business use, according to the volume accommodated by a refrigerator. Also, a refrigerator may be classified into an electric refrigerator, a gas refrigerator, an ice refrigerator, an electronic refrigerator, etc., according to cooling methods. Among them, an electric refrigerator is most widely used.

FIG. 1 is a schematic view of a refrigerator of a related art.

Referring to FIG. 1, a refrigerator roughly consists of a freezer 10 on the left side; a cooling chamber 20 on the right side; and a cooling circulating device for supplying cold air though not shown in FIG. 1. Also, a cold air supplying device 4 consisting of an evaporator(not shown) constituting the cooling circulating device on the upper part and an axial flow fan 3, is provided to the freezer 10.

Cold air is provided to the freezer 10 through the cold air supplying device 4. Here, the cold air is not directly provided but provided through a grill fan 5 positioned on the front side of the cold air supplying device 4.

Namely, the grill fan 5 guides so that the cold air generated from the cold air supplying device 4 may be discharged into the inside of a storing space.

For such purpose, the grill fan 5 has a freezer-discharging hole 11 on a predetermined position, while a freezer-absorbing hole 12 for absorbing cold air again, is provided on the lower end so that the cold air discharged from the discharging hole 11 may be circulated.

In the meantime, the cold air supplying device 4 has, on its one side, a cooling chamber-cold air supplying hole 21, through which cold air could also flow into the cooling chamber 20.

Like the freezer 10, the cooling chamber 20 also has a discharging hole 22 and an absorbing hole 23 for discharging and absorbing the cold air, respectively, and a mullion 6 is formed on the interface, for isolation from the freezer 10.

Also, a plurality of shelves is formed in the inside of the freezer 10 and the cooling chamber 20, so that materials to be stored may be put on each shelf, and a vegetable room for storing vegetables or fruits is separately provided at the lower end of the cooling chamber 20.

Also, the freezer 10 and the cooling chamber 20 are opened and closed, respectively, by a door, for being exposed to the outside. A door basket for receiving materials to be stored, is provided on the inner side of the door.

In the two-door type refrigerator of the related art, having the foregoing construction, materials to be frozen are put on the freezer 10 on the left side, while materials to be kept in a non frozen status, are put on the cooling chamber 20 on the right side.

A cold air supplying method in the inside of the refrigerator through the grill fan 5 and the cooling chamber-cold air supplying hole 21, is described in the following. Firstly, for the freezer 10 on which the grill fan 5 is formed, the inside of the grill fan 5 becomes a supplying tube itself for supplying cold air, and the discharging hole 11 is formed on the position where the grill fan faces each shelf, whereby temperature in the inside of the freezer 10 is uniformly lowered.

In the meantime, for the cooling chamber 20 where cold air is provided only through the cooling chamber-cold air supplying hole 21 connected with the cold air supplying device 4, the cold air is discharged only through the cooling chamber-cold air supplying hole 21, whereby temperature difference is large between the upper part and the lower part of the cooling chamber 20.

Supplying of the cold air into the cooling chamber 20 through the cooling chamber-cold air supplying hole 21 is performed through another grill fan 24 connected with the cold air supplying hole 21. Referring to FIG. 2, the grill fan 24 has a structure in which the cold air is discharged in horizontal direction in parallel with the shelf.

As the cold air discharged through the grill fan 24 having the foregoing structure is concentrated on the upper part of the cooling chamber 20, the temperature of the upper part is low, while the temperature of the lower part of the cooling chamber 20, through which the cold air whose temperature is raised as a result of cooling down the upper part of the cooling chamber 20 passes, gets indispensably high as much as the raised temperature of the cold air.

Namely, the temperature difference between the upper part and the lower part of the cooling chamber 20 gets large, whereby a user should put materials appropriate for semi-freezing on the upper part whose temperature is relatively low and put materials that is possibly stored in just a little lower temperature than room temperature on the lower part regardless of spare space in the inside of the cooling chamber 20, so that usage of the cooling chamber 20 is very limited.

Resultantly, the temperature of the upper part of the cooling chamber 20 becomes relatively low while the temperature of the lower part of the cooling chamber 20 becomes relatively high. Such temperature difference is originated from the fact that the temperature of the inside of the cooling chamber 20 is not uniformly optimized, and therefore, countermeasure to resolve such problem is highly required.

SUMMARY OF THE INVENTION

An object of the invention is to solve at least the above problems and/or disadvantages and to provide at least the advantages described hereinafter.

Accordingly, one object of the present invention is to solve the foregoing problems by providing a structure for discharging cold air in a refrigerator, capable of uniformly maintaining temperature of the inside of the refrigerator regardless of the upper and lower parts, by uniformly distributing cold air discharged from the upper part of the refrigerator, over the whole refrigerator.

In order to achieve the foregoing object, a structure for discharging cold air in a refrigerator according to the present invention, is characterized in providing a refrigerator having a cold air discharging hole through which cold air generated from the cold air supplying device is discharged, wherein the cold discharging hole is provided, vertically downward, at the inner point of 30 mm–50 mm from the end of the shelf.

Also, the cold air discharging hole is preferably provided, vertically downward, at each shelf.

Also, it is preferable that the refrigerator includes the freezer on the left side, for receiving materials to be frozen and the cooling chamber on the right side, for receiving materials to be stored in a non frozen status, and the refrigerator is a two-door type refrigerator where the freezer and the cooling chamber are opened and closed by left and right doors, respectively.

The present invention is characterized in providing a refrigerator having the freezer on the left for receiving materials to be frozen and the cooling chamber for receiving materials to be stored in a non frozen status, each of which is opened and closed by door, the refrigerator includes a cold air supplying device for supplying cold air to the freezer and the cooling chamber; a cooling chamber-cold air supplying hole provided on the side of the cold air supplying device, for also supplying cold air to the cooling chamber, too; a grill fan for guiding so that cold air supplied through the cooling chamber-cold air supplying hole may be discharged into the inside of the storing space in the cooling chamber; and a cold air discharging hole that has been provided, in horizontal direction, with respect to the grill fan and that is presently provided, vertically downward, at the ceiling of the refrigerator.

Also, the cold air discharging hole is preferably provided, vertically downward, on all the shelves.

Also, the cold air discharging hole is preferably provided, vertically downward, at the inner point of 30 mm–50 mm from the end of the shelf.

Also, the refrigerator is preferably a two-door type refrigerator having the freezer on its left side and the cooling chamber on its right side, each of which is opened and closed by left and right doors, respectively.

As mentioned above, the present invention does not discharge cold air in horizontal direction as was done in the related art, but discharges cold air vertically downward, so that the cold air is uniformly distributed regardless of the upper and the lower part of the refrigerator. Therefore, the temperature difference between the upper part and the lower part of the refrigerator is reduced and the temperature in the inside of the refrigerator could be uniformly maintained.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF PREFERRED EMBODIMENTS

The following detailed description will present a structure for discharging cold air in a refrigerator according to a preferred embodiment of the invention in reference to the accompanying drawings.

Figure 1:
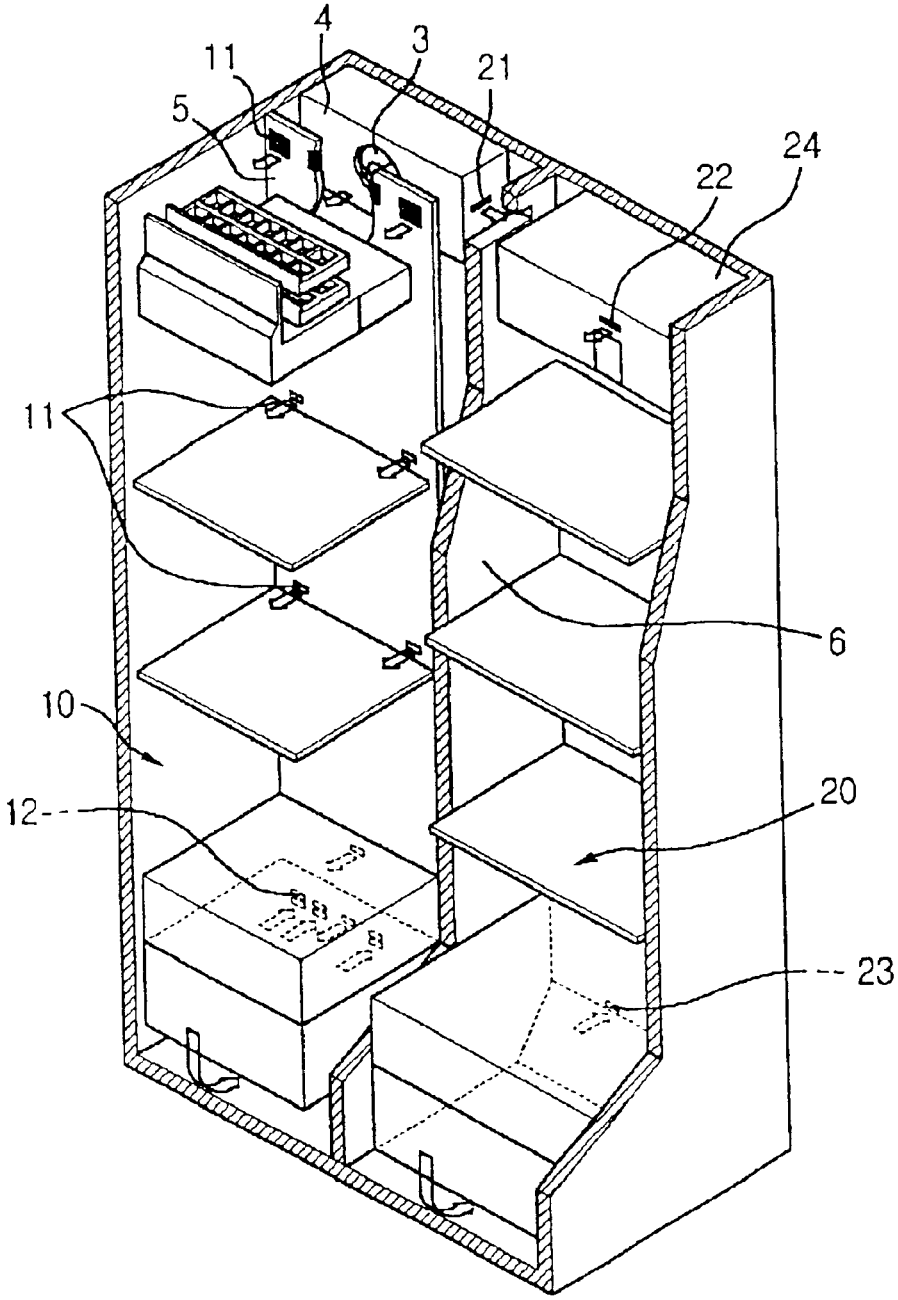
Fig.1 Related Art
FIG. 1 is a schematic view of a refrigerator of a related art.
Figure 2:
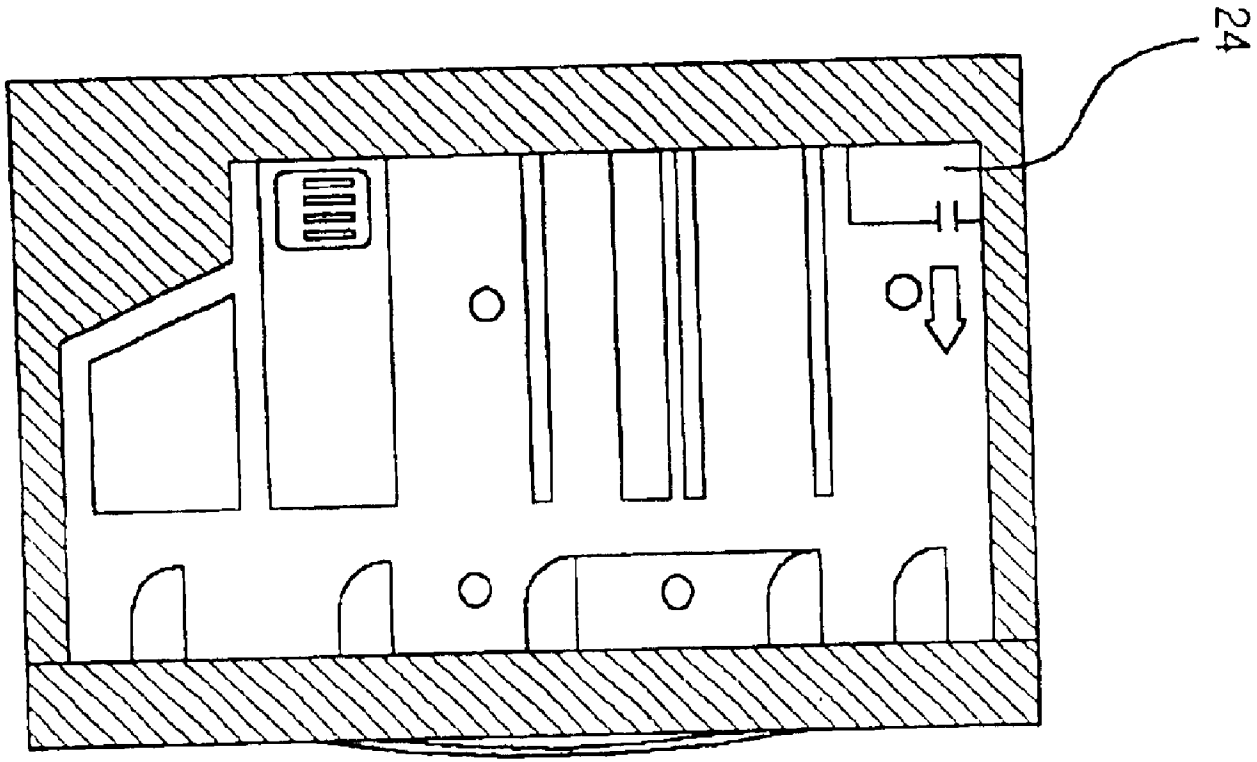
Fig.2 Related Art
FIG. 2 is a sided, cross-sectional view of a structure for discharging cold air in a refrigerator of a related art.
Figure 3:
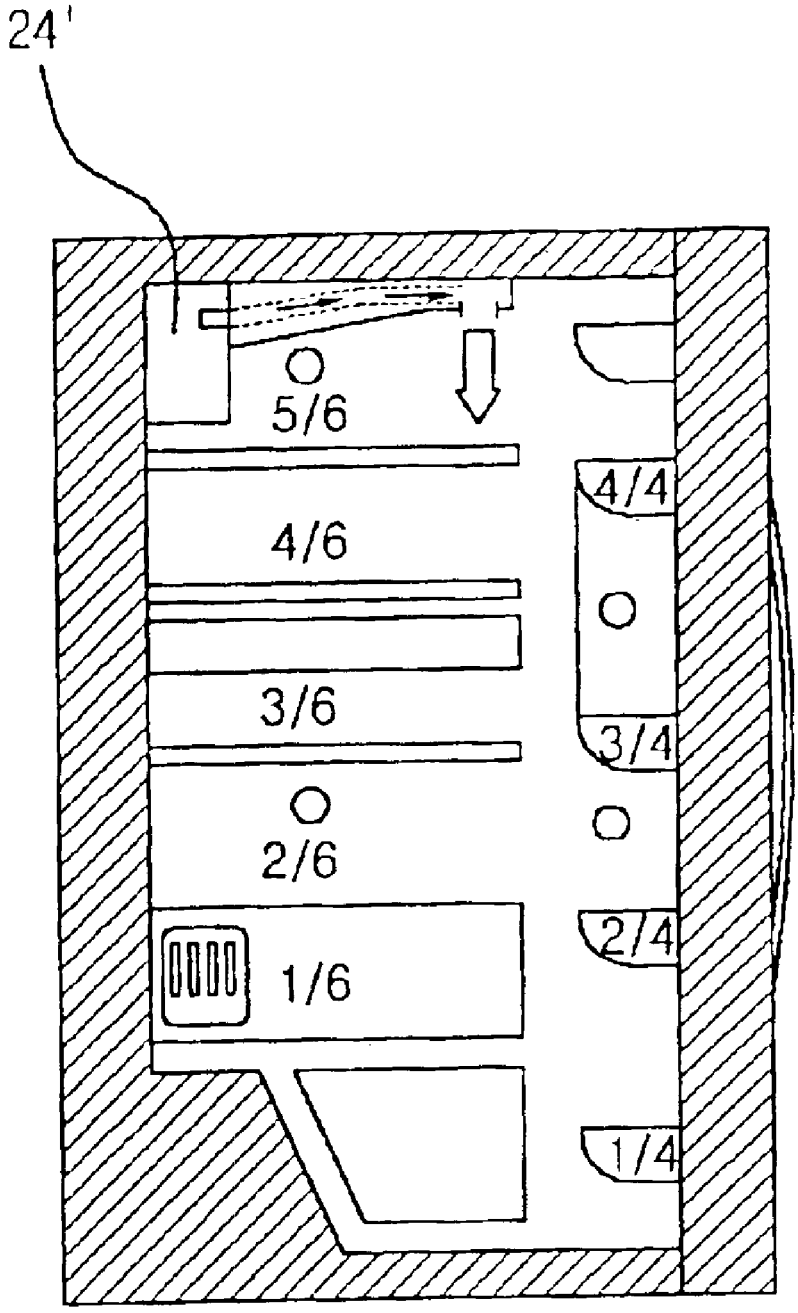
FIG. 3 is a sided, cross-sectional view of a structure for discharging cold air in a refrigerator according to a preferred embodiment of the present invention.

FIG. 3 is a sided, cross-sectional view of a structure for discharging cold air in a refrigerator according to a preferred embodiment of the present invention.

Referring to FIG. 3, it is shown that the cold air discharging hole that has been provided, in horizontal direction, with respect to the grill fan 24' positioned on the upper part of the refrigerator, is formed, vertically downward, at the ceiling of the refrigerator. Therefore, the cold air that has been discharged in horizontal direction according to the related art, is presently being discharged in vertically downward direction.

Of course, it is possible to provide, vertically downward, the discharging hole at the shelf formed in the inside of the refrigerator, if necessary, as well as at the ceiling of the refrigerator.

According to the above-mentioned vertically downward discharging method, the cold air could be uniformly discharged in the inside of the refrigerator, but the discharged cold air is blocked off by the shelf. Therefore, cold air distribution shows great difference depending on position relations between the discharging hole and the shelf.

Figure 4:
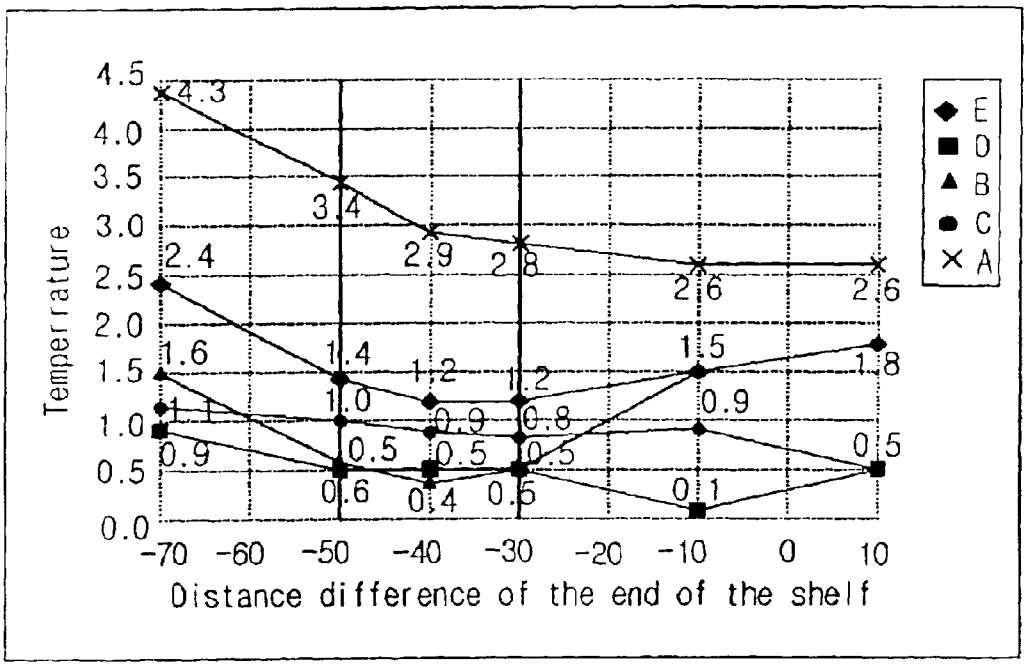
FIG. 4 is a graph showing temperature difference of the inside of the refrigerator depending on distance difference from the end of the shelf in the method for discharging cold air according to a preferred embodiment of the present invention.

FIG. 4 is a graph showing temperature difference of the inside of the refrigerator depending on distance difference from the end of the shelf in the vertically downward discharging method.

Referring to FIG. 4, the graph shows that the temperature difference is smallest for the case that the cold air discharging hole is positioned at the inner point of 30 mm–50 mm from the end of the shelf.

More specifically, A stands for the temperature difference of B1/4. Here, B1/4 stands for the basket at the lowest end among baskets formed in the inside of the door in FIG. 3, and generally a basket at the lowest end in the inside of the door is considered as B1/4.

The A shows that temperature gets lower as the cold air discharging hole installed in vertically downward direction is provided in the outer direction, for an amount that the cold air discharged from the cold air discharging hole is blocked off, is reduced.

The B stands for a shelf difference, namely, temperature difference between shelves in the inside of the refrigerator. According to the B, it is revealed that temperature difference is smallest for the point of 30 mm–50 mm and large for other points. In case that the point is positioned more inward than 30 mm–50 mm, cooling is concentrated on the upper part where the cold air discharging hole is provided and temperature difference gets large, while in case that the point is positioned more outward than 30 mm–50 mm, the cold air discharged from the cold air discharging hole is not supplied to the shelf in the upper part but directly supplied to the shelf in the lower part, so that the shelf in the lower part of the refrigerator is cooled down and temperature difference gets also large.

The C stands for a basket difference, namely, temperature difference between baskets in the inside of the refrigerator door. According to the C, it is revealed that temperature difference is smallest in case that the cold air discharging hole is formed on the outer side of 10 mm from the end of the shelf, but showing no great difference compared to temperature differences between other cases.

The D stands for temperature difference between the shelf and the basket positioned at the same height. According to the D, it is revealed that temperature difference is smallest in case that the cold air discharging hole is formed on the inner side of 10 mm from the end of the shelf, but showing no great difference compared to temperature differences between other cases like the cases of the C.

The E stands for average temperature difference for each compartment in the shelf side and the door side. According to the E, it is revealed that temperature difference is smallest in case that the cold air discharging hole is formed, vertically downward, at the inner side of 30 mm–50 mm from the end of the shelf.

The E could be directly perceived by us and is a factor having influence on materials to be stored. Therefore, it is preferable that the cold air discharging hole is formed, vertically downward, at the inner side of 30 mm–50 mm from the end of the shelf on the basis of the F.

As is apparent from the foregoing, the structure for discharging cold air in the refrigerator according to the present invention, uniformly distributes the cold air regardless of the upper part and the lower part of the refrigerator, by discharging the cold air in vertically downward direction. Therefore, temperature difference between the upper part and the lower part is reduced, whereby temperature in the inside of the refrigerator could be uniformly maintained.

Thanks to such structure having the foregoing advantages, additional equipment and space for supplying cold air to the shelf are not necessary any more like the case of the freezer or the cooling chamber according to the related art, having the structure where the discharging hole is formed on each shelf. Therefore, the space of the refrigerator could be effectively used.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A refrigerator for optimizing inside temperature of a cooling chamber, having a freezer for receiving materials to be frozen and a cooling chamber for receiving materials to be stored in a non-frozen state, each of which is opened and closed by a door, the refrigerator comprising:

a cold air supplying device for supplying cold air to the freezer and the cooling chamber;

a cooling chamber-cold air supplying hole provided on one side of the cold air supplying device, for supplying the cold air to the cooling chamber;

a grill fan for guiding the cold air so that the cold air supplied through the cooling chamber-cold air supplying hole may be discharged into an inside of a storing space in the cooling chamber; and a cold air discharging hole provided, oriented vertically downward, adjacent a ceiling of the refrigerator.

2. The refrigerator according to claim 1, wherein a cold air discharging hole is provided, oriented vertically downward, at each of a plurality of shelves positioned in the cooling chamber.

3. The refrigerator according to claim 1, wherein the cold air discharging hole is provided, oriented vertically downward, at an inner point of 30 mm–50 mm from an end of a shelf.

4. The refrigerator according to claim 1, wherein the refrigerator is a two-door type refrigerator having the freezer on one side and the cooling chamber on another side, each of which is opened and closed by respective doors.

5. A structure for optimizing a temperature of a cooling chamber of a refrigerator, comprising a cold air discharging device configured to discharge cold air generated from a cold air supplying device, wherein the cold air discharging device is configured to discharge substantially all of the cold air provided to the cold air discharging device from the cold air supplying device in a vertically downward direction so as to uniformly cool the cooling chamber.

6. The structure according to claim 5, wherein the cold air discharging device comprises a plurality of cold air discharging holes provided; at each of a plurality of shelves positioned in the cooling chamber, wherein each of the plurality of holes is configured to discharge cooling air vertically downward.

7. The structure according to claim 5, wherein the cold discharging device is provided at an upper surface of the cooling chamber, and positioned 30 mm–50 mm from an end of a shelf.

8. The structure according to claim 5, wherein the refrigerator comprises a freezer on one side configured to receive items to be frozen and a cooling chamber on another side configured to receive items to be stored in a non-frozen state, and wherein the refrigerator comprises a two-door type refrigerator where the freezer and the cooling chamber are opened and closed by first and second doors, respectively.

9. The structure according to claim 5, wherein the cold air discharging device comprises a cold air discharging hole provided adjacent a ceiling portion of the cooling chamber, wherein the cooling air discharge hole is configured to discharge cooling air vertically downward.

10. The structure according to claim 5, wherein a position of the cold air discharging device in the refrigerator is based on cooling characteristics of the cooling chamber.

11. The structure according to claim 5, wherein the cold air discharging device comprises a plurality of cold air discharging holes oriented in a vertically downward direction and positioned throughout the cooling chamber.

12. The structure according to claim 11, wherein at least one of the plurality of cold air discharging holes is provided at a ceiling portion of the cooling chamber.

13. The structure according to claim 12, wherein at least one of the plurality of cold air discharging holes is provided at each of a plurality of shelves provided in the cooling chamber.

14. A refrigerator comprising the structure according to claim 5.

15. A structure for optimizing a temperature of a cooling chamber of a refrigerator, comprising at least one cold air discharging hole configured to discharge substantially all of the cold air provided to the at least one cold air discharging hole by a cold air supplying device in a vertically downward direction.

16. The structure according to claim 15, wherein the at least one cold air discharging hole is positioned at a ceiling of the refrigerator.

17. The structure according to claim 15, wherein the at least one cold air discharging hole comprises a plurality of cold air discharging holes, and wherein at least one of the plurality of cold air discharging holes is provided at each of a plurality of shelves positioned in the cooling chamber.

18. The structure according to claim 15, wherein the refrigerator comprises a freezer on one side configured to receive items to be frozen, and a cooling chamber on another side configured to receive items to be stored in a non-frozen state, and wherein the refrigerator is a two-door type refrigerator where the freezer and the cooling chamber are opened and closed by first and second doors, respectively.

19. A refrigerator comprising the structure according to claim 15.

20. A structure configured to optimize a temperature of a chamber, comprising:

an air supply generator configured to generate a supply of air;

an air supply receiver provided proximate the air supply generator and configured to receive a supply of air from the air supply generator and to deliver the supply of air to the chamber; and at least one air discharge hole configured to discharge substantially all of the supply of air received by the air supply receiver into the chamber in a vertically downward direction so as to maintain a substantially uniform temperature throughout the chamber.

21. The structure of claim 20, wherein the at least one air discharge hole comprises a plurality of air discharge holes, wherein at least one air discharge hole is provided in a ceiling portion of the chamber, and at least one air discharge hole is provided at each of a plurality of shelves positioned within the chamber.

22. The structure of claim 21, wherein the at least one air discharge hole provided in the ceiling portion of the chamber is positioned 30 mm–50 mm from an end of a respective one of the plurality of shelves.

23. The structure of claim 21, wherein the chamber comprises a cooling chamber of a refrigerator.

24. The structure of claim 23, wherein the air supply generator comprises a cold air supply device configured to supply cold air to a freezer and the cooling chamber of the refrigerator.

25. The structure of claim 24, wherein the air supply receiver comprises a cooling chamber cold air supply device provided proximate the cold air supply device and configured to supply cold air from the cold air supply device to the cooling chamber.

26. The structure of claim 25, wherein the at least one air discharge hole is configured to discharge substantially all of the cold air supplied to the cooling chamber cold air supply device into the cooling chamber so as to uniformly cool the cooling chamber.

27. The structure of claim 23, wherein the refrigerator comprises a two door refrigerator with a freezer on one side and a cooling chamber on the other side, each of which is opened and closed by respective doors.

28. A refrigerator for optimizing inside temperature of a cooling chamber, having a cold air discharging hole through which cold air generated from a cold air supplying device is discharged, the refrigerator being configured such that the cold discharging hole is provided, oriented vertically downward, at an inner point of 30 mm–50 mm from an end of a shelf.

29. The refrigerator according to claim 28, wherein the cold air discharging hole is provided, oriented vertically downward, at each of a plurality of shelves positioned in the cooling chamber.

30. The refrigerator according to claim 28, wherein the refrigerator comprises:

a freezer on a left side, for receiving materials to be frozen; and a cooling chamber on a right side, for receiving materials to be stored in a non-frozen state, wherein the refrigerator is a two-door type refrigerator where the freezer and the cooling chamber are opened and closed by left and right doors, respectively.

* * * * *